US009028167B2

(12) United States Patent
Buschmann et al.

(10) Patent No.: US 9,028,167 B2
(45) Date of Patent: May 12, 2015

(54) CONSTRUCTION MACHINE WITH MATERIAL CONVEYING SYSTEM

(71) Applicant: Joseph Voegele AG, Ludwigshafen/Rhein (DE)

(72) Inventors: Martin Buschmann, Neustadt (DE); Steffen Fickeisen, Bad Duerkheim (DE); Laszlo Godard, Neustadt (DE)

(73) Assignee: Joseph Voegele AG (DE)

( * ) Notice: Subject to any disclaimer, the term of this patent is extended or adjusted under 35 U.S.C. 154(b) by 0 days.

(21) Appl. No.: 14/032,500

(22) Filed: Sep. 20, 2013

(65) Prior Publication Data

US 2014/0086685 A1 Mar. 27, 2014

(30) Foreign Application Priority Data

Sep. 21, 2012 (EP) ..... 12006643

(51) Int. Cl.
*E01C 9/00* (2006.01)
*E01C 19/00* (2006.01)
*E01C 19/48* (2006.01)

(52) U.S. Cl.
CPC ..... *E01C 19/002* (2013.01); *E01C 19/48* (2013.01)

(58) Field of Classification Search
CPC ..... E01C 19/002; E01C 19/48
USPC ..... 404/101, 105, 118
See application file for complete search history.

(56) References Cited

U.S. PATENT DOCUMENTS

| | | | | |
|---|---|---|---|---|
| 3,270,633 | A | 9/1966 | Holland | |
| 6,193,437 | B1 | 2/2001 | Heims | |
| 8,342,774 | B2 | 1/2013 | Fickeisen | |
| 2011/0176868 | A1 * | 7/2011 | Musil et al. | 404/72 |
| 2013/0062164 | A1 | 3/2013 | Buschmann et al. | |

FOREIGN PATENT DOCUMENTS

| | | | |
|---|---|---|---|
| DE | 1459716 | A1 | 12/1968 |
| DE | 202008010719 | U1 | 10/2008 |
| EP | 0957204 | A1 | 11/1999 |
| EP | 1213390 | A2 | 6/2002 |
| EP | 2377994 | A1 | 10/2011 |
| JP | 08073044 | A | 3/1996 |
| JP | 08085631 | A | 4/1996 |
| JP | 61145727 | U | 9/1996 |
| JP | 09158112 | A | 6/1997 |
| WO | 2007117287 | A1 | 10/2007 |
| WO | 2009061278 | A1 | 5/2009 |

OTHER PUBLICATIONS

Extended European Search Report Dated Mar. 6, 2013, Application No. 12006643.6-1604, Applicant Joseph Voegele AG, 6 pages.
Japanese Office Action dated Dec. 2, 2014, Application No. 2013-187193, Dispatch No. 6165814 Pages.

* cited by examiner

*Primary Examiner* — Raymond W Addie
(74) *Attorney, Agent, or Firm* — Brooks Kushman P.C.

(57) ABSTRACT

A construction machine according to the disclosure comprises a material hopper for receiving bulk material. Moreover, the construction machine includes a material conveying system for conveying bulk material. The material conveying system comprises at least one conveying screw in the area of the hopper. A gap extends underneath the at least one conveying screw, and the gap has a cross section that varies in a conveying direction of the at least one conveying screw.

20 Claims, 5 Drawing Sheets

CONSTRUCTION MACHINE WITH MATERIAL CONVEYING SYSTEM

CROSS-REFERENCE TO RELATED APPLICATIONS

This application claims foreign priority benefits under 35 U.S.C. §119(a)-(d) to European patent application number EP 12 006 643.6, filed Sep. 21, 2013, 2012, which is incorporated by reference in its entirety.

TECHNICAL FIELD

The disclosure relates to a construction machine with material conveying system.

BACKGROUND

Bituminously bound mixtures are produced in mixing systems. This is done by heating stone chippings in a rotary furnace and subsequently feeding them to a mixer. In this mixer, hot bitumen is additionally injected and mixed with the hot stone chippings. This mixture is then temporarily stored in hot silos or transported directly to the road construction site by means of trucks. The asphalt leaves the mixer at a high and very uniform temperature. The mixture cools in a non-uniform manner due to subsequent storage and particularly due to transportation. Typically, the asphalt still has a very high core temperature when delivered to the construction site, but the edge areas have cooled significantly. There is then no longer a mixture with a uniform temperature. A uniform temperature distribution in the mixture is one of the most important parameters for laying and compacting asphalt. Many material characteristics of the asphalt depend on this temperature. This is substantially associated with the viscosity of the bitumen, which viscosity changes with the temperature. A non-uniform temperature of the mixture is therefore a factor that has a negative influence on the quality of the road surface. It leads to density differences in the load-bearing capacity, as well as to flaws in the layer thickness and, as a result, to unevenness in the road surface.

These findings have been used and implemented in a feeder system that is intended to improve the homogeneity of the mixture temperature. To this end, one uses, e.g., conveying screws that are arranged in the material hopper such that they are transverse to the main conveyor flow. Such a system is for instance disclosed in WO 2007/117287 A1. Due to the conveying screws, colder mixture is continuously conveyed from the edge areas into the hotter main conveyor flow during the feeding process. This ongoing mixing leads to improved temperature homogeneity in the mixture. It is here important that a so-called tunnel effect is substantially avoided. This effect occurs in screws of a constant pitch and a constant outer diameter. As soon as the first winding of the screw has been filled with material, no further material can pass from the top into the winding, whereby the desired mixing effect fails to take place. The above-mentioned disclosure therefore describes conveying screws of a variable pitch and of a variable outer diameter, respectively, of the screw flank.

WO 2009/061278 A1 describes a conveyor device for a road construction vehicle. The conveyor device comprises a material hopper for accommodating paving mixture, the material hopper comprising two hopper halves with transverse conveying screws disposed therein. Owing to the transverse conveying screws the paving mixture is transported out of the hopper halves onto a longitudinal conveyor device. It is here possible to set the speed of the transverse conveying screws independently of the speed of the longitudinal conveyor device.

The applicant's EP 2 377 994 A1 discloses a similar method with a plurality of transverse conveying screws that can be operated independently of one another. A temperature measuring system is there used in addition.

EP 0 957 204 A1 discloses a road paver with transverse conveying devices that are arranged in hopper halves, various sections of the hopper halves being pivotable about the transverse conveying means such that residual material slides towards the transverse conveying means.

Further concepts for optimizing the temperature of the mixture are disclosed in DE 20 2008 010 719 U1 and in EP 1 213 390 A2, both issuing from the applicant. The first one provides an additional heater for the mixture, said heater exploiting the engine waste heat of the conveyor vehicle. The latter refers to a special configuration of a conveyor belt for a mixture that tends to adhere and/or to solidify.

SUMMARY

It is an object of the present disclosure to provide a construction machine of which the design is improved in the simplest possible way, in order to improve the quality of the mixture processed therein.

The preferably mobile construction machine according to the disclosure comprises a material hopper for receiving bulk material. Furthermore, it comprises a material conveying system for conveying the bulk material, the material conveying system in the area of the hopper comprising at least one conveying screw. The construction machine is characterized in that a gap extends underneath the conveying screw; said gap extends substantially in parallel with an axis of the conveying screw, i.e., the central axis of the gap and the axis of the conveying screw in a top view from above intersect at an angle ≤30°, preferably ≤15°. A further feature of the disclosure is that the cross section of the gap varies in the conveying direction of the conveying screw. This offers the advantage that the above-described tunnel effect can also be counteracted if a conventional conveying screw is used. Material can escape through the gap downwards out of the screw, whereby new material can pass from above into the screw. This creates a mixing process in the screw and accomplishes enhanced uniformity in terms of temperature and grain sizes of the mixture. Hence, the construction machine according to the disclosure makes it possible to achieve the desired mixing effect even with a constant conveying screw. This reduces the production costs of the conveying screws considerably as the manufacture of conveying screws with conical core shafts or of conveying screws having an outer diameter varying in conveying direction is much more complicated and, in addition, offers significantly less opportunities to use identical parts.

It is advantageous when the gap is open downwards and when a downstream conveying system that supports the further transport of the mixture extends thereunder. As a result, the material that escapes downwards out of the screw can be transported off more quickly, and room is created both in the gap and in the conveying screw for further succeeding material, whereby the mixing effect is further increased. Moreover, both the energy demand and the torque to be applied are decreasing on the screws as the material is further transported not exclusively by the screws, but also by the downstream conveying system. The downstream conveying system may e.g., comprise a scraper belt or, however, any other suitable conveying means for bulk material.

It is expedient when the conveying screw is arranged in a trough and the gap extends along a bottom side of the trough. This provides for an improved conveying action of the conveying screw and additionally ensures that all material is conveyed into the desired direction and does not escape e.g., laterally in a radial direction of the conveying screw. The trough may have any desired, e.g., U-shaped, cross-section. It may particularly be adapted to the geometry of the conveying screw. Also the opening angle between the trough walls can be freely chosen within the range between 0° and 180°.

Moreover, it is conceivable that the material conveying system comprises a plurality of conveying screws each with a respective axis. This makes it possible to provide a plurality of conveyor flows the combination of which further enhances the mixing action of the conveyor system. Finally, the provision of a plurality of conveying screws affords an enhanced conveying capacity of the system.

It is particularly advantageous when the conveying screws can be operated independently of one another. This makes it possible to configure the various conveyor flows in a much more flexible manner. For instance, various mixing ratios of different conveyor flows can be changed in a targeted manner, so that an optimum preparation of the mixture is rendered possible under very different conditions.

It is advantageous when the conveying screws are arranged such that their axes extend at an angle or in parallel with one another. The first configuration permits the combination of different conveyor flows. The latter can for instance allow for an enhanced conveying capacity.

It is also conceivable that the conveying screws are arranged in a plurality of groups, wherein the axes of the conveying screws within one group extend in parallel with one another.

It is particularly advantageous when the various groups are arranged such that the axes of the conveying screws of different groups extend at an angle different from zero relative to one another. This can increase the conveying volume and combine different conveyor flows at the same time. Moreover, an area that is as large as possible can thereby be covered with the conveying screws.

In a further variant the pitch of the at least one conveying screw can vary in conveying direction. This increases the pitch volume of the screw along the conveying path, so that more and more material can succeed. The mixing action of the conveying system is thereby further enhanced.

In a further variant the screw shaft of the at least one conveying screw may be conical. In this case, too, the mixing effect is improved by increasing the pitch volume along the conveying path.

In a further variant the flank of the screw thread of the conveying screw may have an outer diameter that changes in conveying direction or remains constant. In the first-mentioned case this increases the pitch volume again along the conveying path, which enhances the mixing effect. In the second case the production costs are much lower.

It may be advantageous when the at least one conveying screw is supported only at one side or end. The omission of a two-sided bearing also renders a second bearing block, which might present an obstacle to the material flow, superfluous.

In a further variant the construction machine may comprise at least one further conveying system arranged downstream of the conveying screw, and the at least one conveying screw may be operable in response to operating parameters of said downstream conveying system. The conveyor flows caused by the conveying screw or by the plurality of conveying screws can thus be adapted to the downstream conveying system.

It is particularly advantageous when the construction machine further comprises a control system which controls the different conveyor flows produced by the conveying screws and their ratio among one another. Such a control system simplifies the control of the construction machine. Moreover, a more accurate adjustment of the system parameters can thereby be achieved. In addition, a control system permits the continuous monitoring and adaptation of the operating parameters of the construction machine. It can thereby be ensured that predetermined operating states or operating states which are optimally adapted to the respective ambient conditions can be maintained at any time.

The construction machine may e.g., be a road paver or a feeder.

The disclosure relates to construction machines with a material conveying system of the aforementioned type.

An advantageous embodiment of the disclosure shall now be explained hereinafter with reference to the attached drawings.

DETAILED DESCRIPTION

Figure 1:
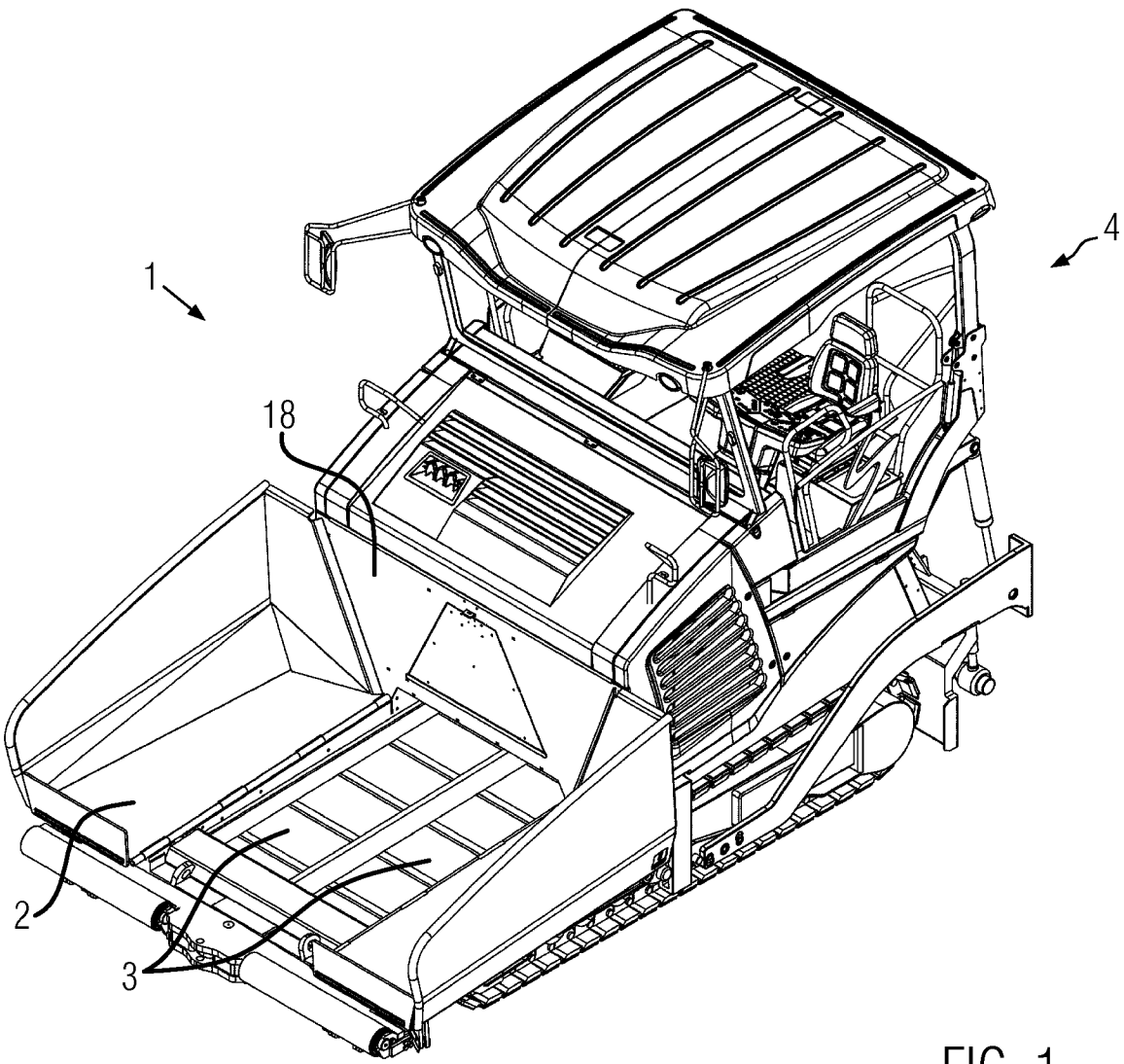
FIG. 1 is a perspective view of a construction machine, in this example a road paver according to the disclosure; however, another construction machine is also possible.

FIG. 1 shows a construction machine 1 with a material hopper 2 for a mixture or, in general, bulk material. A downstream conveying system 3, in this instance two scraper belts, extends in a central portion of the hopper 2. This downstream conveying system 3 serves the transportation of the mixture underneath a driver's cab 4 to the paving site.

Figure 2:
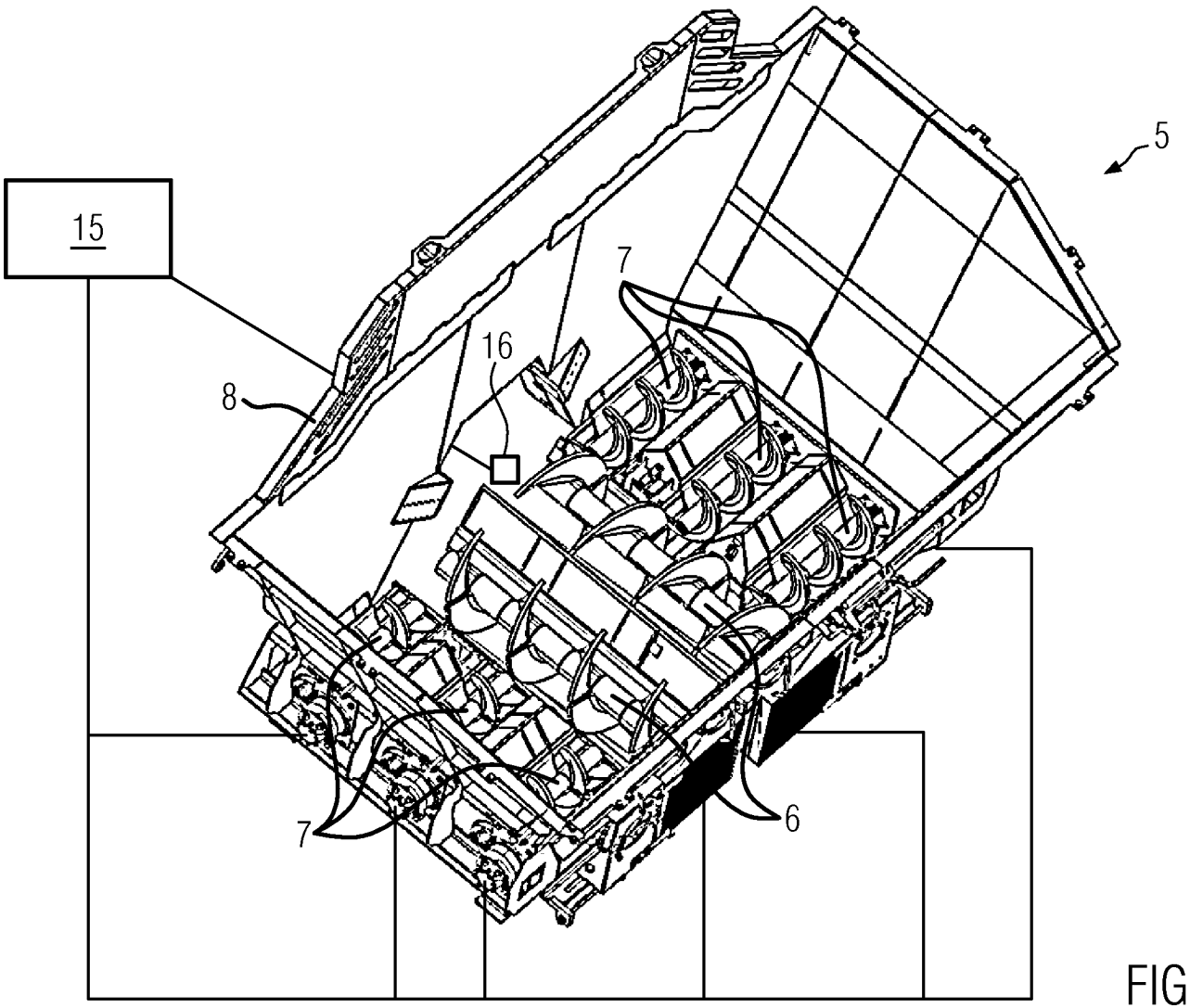
FIG. 2 is a perspective view of a material conveying system according to the disclosure with all conveying screws and a schematically illustrated control system with a sensor.

FIG. 2 shows a material conveying system 5 which may be arranged in the hopper 2. It comprises two longitudinal conveying screws 6 and six transverse conveying screws 7 as well as a rear wall 8. In the installed state said rear wall 8 is oriented towards the rear wall 18 of the hopper. As can be seen in FIG. 2, the conveying screws 6, 7 cover the whole bottom area of the material conveying system. Since the conveying screws 6, 7 are operable independently of one another, the various material flows from the various portions of the material conveying system 5 can be controlled in a targeted manner. For instance, at the beginning of the paving process it is possible to primarily convey material positioned far away from the rear wall 8, to the longitudinal conveying screws 6 so as to mix it subsequently with the material that is closer to the rear wall 8 and thus also closer to the primary drive, normally an internal combustion engine, and therefore stays warm for a longer period of time. Due to the mixing process the temperature of the material issuing from different portions is equalized, so that the finally laid material has a uniform temperature over the whole paving section.

Figure 3:
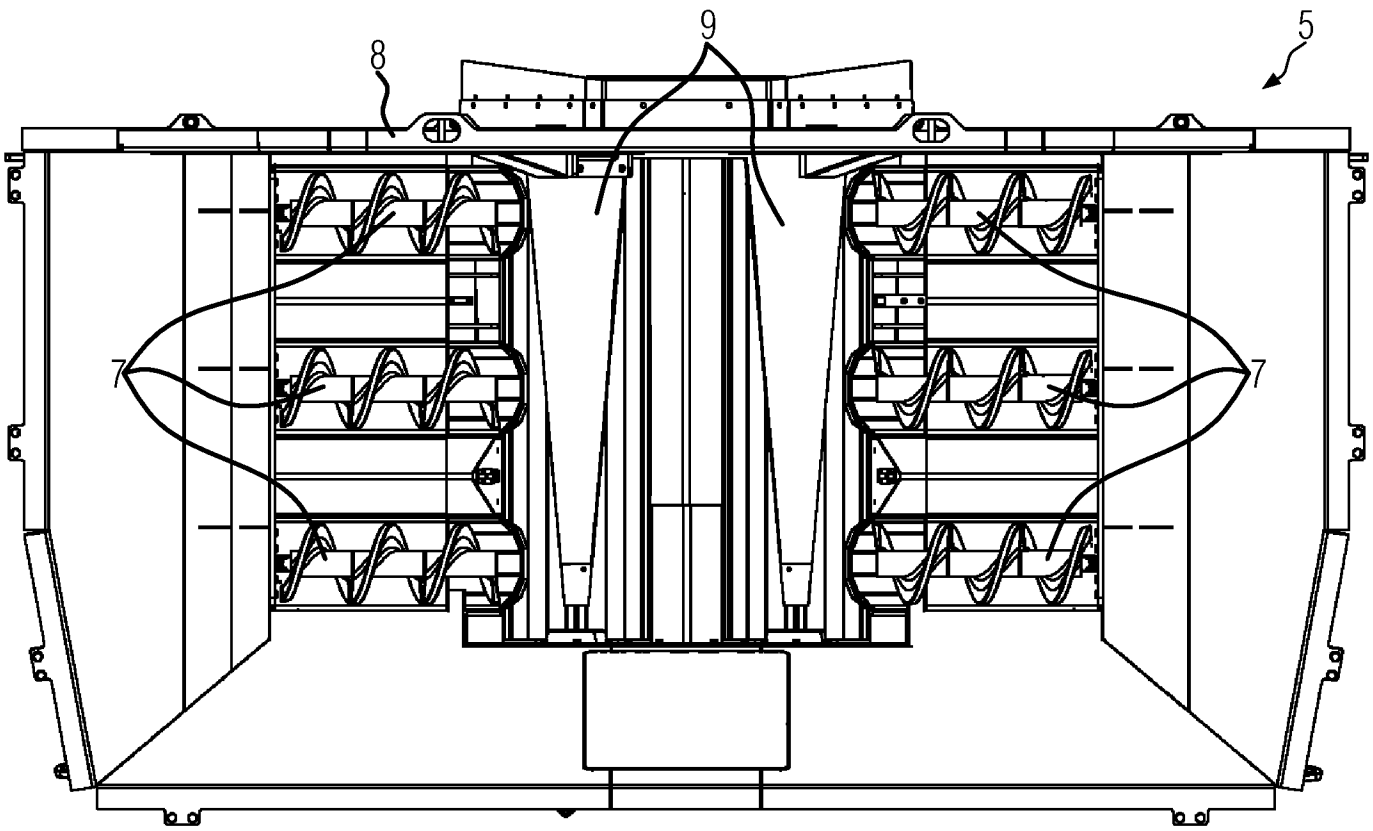
FIG. 3 is a top view from above on a material conveying system according to the disclosure, wherein the longitudinal conveying screws are not illustrated here, so that the gap respectively disposed thereunder is visible.

FIG. 3 shows a top view on the material conveying system 5 without the longitudinal conveying screws 6. Two gaps 9 that are arranged underneath the longitudinal conveying screws 6 and broaden towards the rear wall 8 are shown between the transverse conveying screws 7. In this embodiment, the gaps 9 in a top view are open downwards, so that the material falling therethrough falls directly onto the downstream conveying system 3, which is not shown in this figure. It is however also possible that the gap 9 in a top view is closed downwards and is provided on its bottom side for instance with an inclined plane sloping towards the rear wall 8, so that the material that escapes from the longitudinal conveying screw 6 into the gap is further transported with the help of the downhill force. In any case the gap 8 is opened towards the rear wall 8 so as to pass material on to the downstream conveying system 3 at this opening at the latest.

Figure 4B:
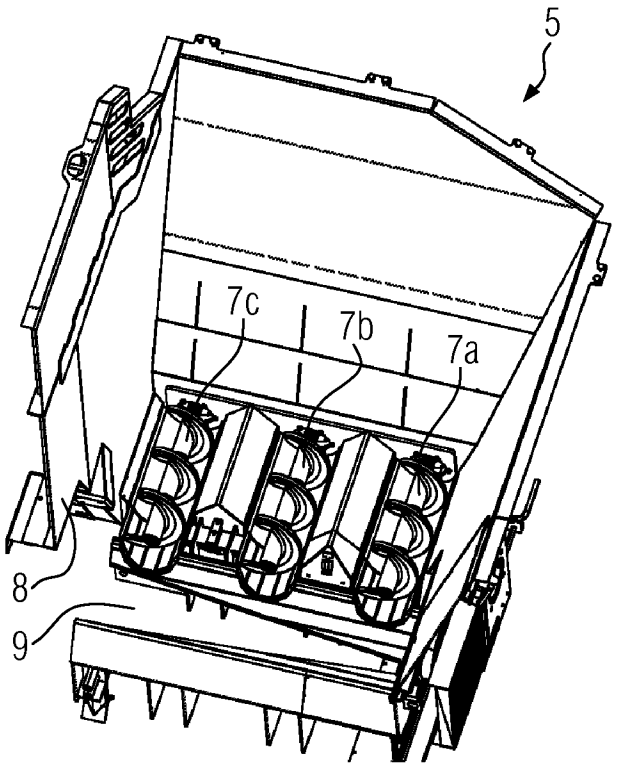
FIG. 4*b* shows the same perspective view as FIG. 4*a*, wherein the longitudinal conveying screw is not illustrated again so as to make the gap visible that is positioned thereunder.
Figure 4A:
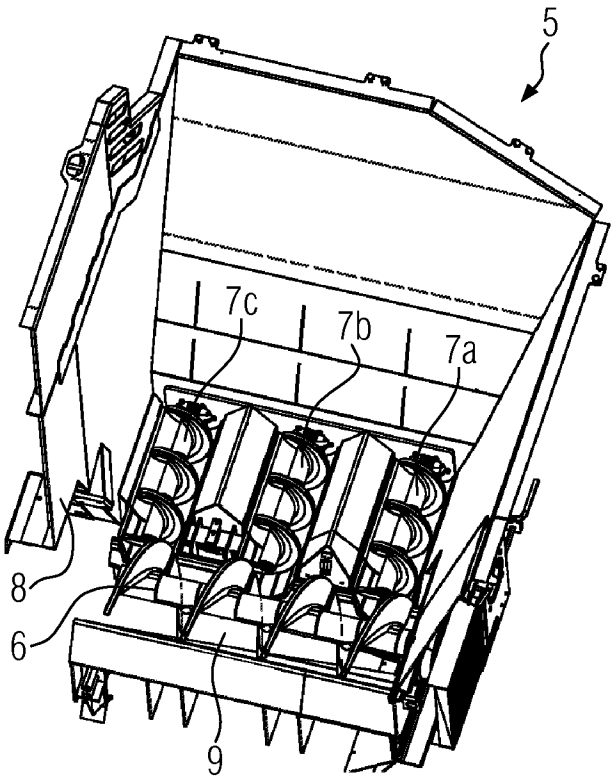
FIG. 4*a* is a perspective sectional view of a material conveying system according to the disclosure.

FIG. 4*a* and FIG. 4*b* show a perspective sectional view of a material conveying system 5 according to the disclosure. The longitudinal conveying screw 6 is not shown in FIG. 4*b*. In the illustrated embodiment, the transverse conveying screws 7*a*, 7*b* and 7*c* form one group. Their axes extend each in parallel with one another. Material from different portions of the material conveying system 5 can thereby be conveyed towards the longitudinal conveying screw 6. Since the transverse conveying screws 7*a*, 7*b* and 7*c* are operable independently of one another, conveyor flows from different portions of the material conveying system 5 can be adapted in a targeted manner at different times.

On the basis of FIGS. 4*a* and 4*b*, the function of the material conveying system 5 shall now be described. A mixture that is filled into the material conveying system 5 is first of all conveyed by all transverse conveying screws 7 in the direction of the longitudinal conveying screw 6. It may happen here that the first transverse conveying screw 7*a* already completely fills a winding of the longitudinal conveying screw 6. Due to a rotation of the longitudinal conveying screw 6 the completely filled winding is further delivered to the next transverse conveying screw 7*b*. Now, if the material could not escape out of the winding, the transverse conveying screw 7*b* would not be in a position to pass material on to the longitudinal conveying screw 6. Hence, the material conveyed by the transverse conveying screw 7*a* to the longitudinal conveying screw 6 would be transported past the two remaining transverse conveying screws 7*b* and 7*c* directly to the downstream conveying system 3. This would be of disadvantage in cases where for instance a particularly cold or a particularly coarse-grained mixture was positioned in the area of the transverse conveying screw 7*a*. This mixture would then be laid primarily in a first paving section, which would have a negative effect e.g., on the load-bearing capacity of the later road surface. In a material conveying system according to the disclosure, material can escape from the completely filled winding of the longitudinal conveying screw 6 downwards through the gap 9, thereby creating room for material that is conveyed by the screw 7*b* to the longitudinal conveying screw 6. A thorough mixing of the paving material thereby takes place, which leads to a more uniform pavement that is thus of a higher quality.

Figure 5B:
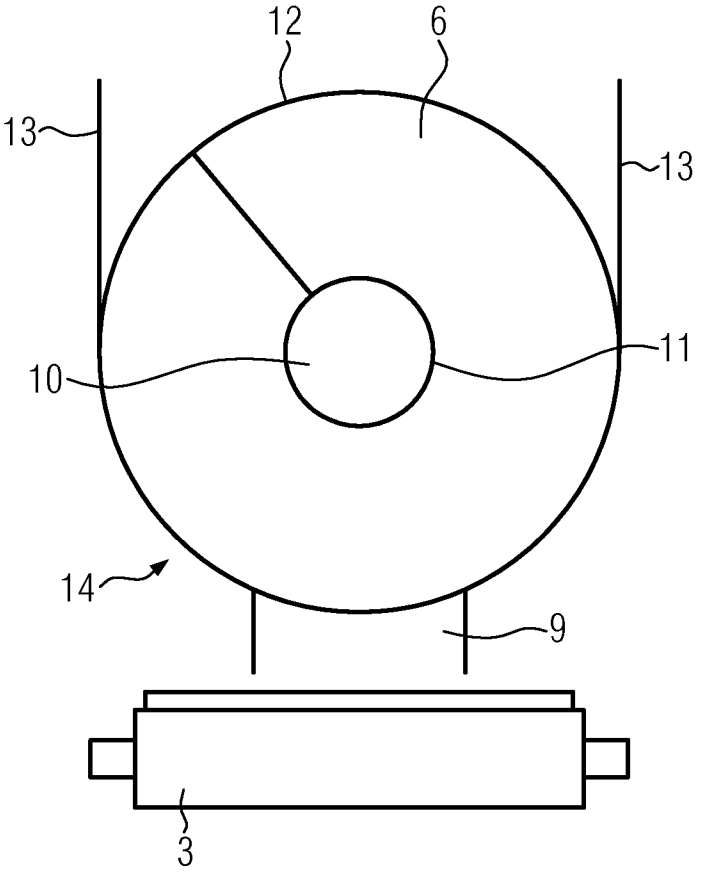
FIG. 5*b* shows the same schematic view as FIG. 5*a*, but in this case, an embodiment is illustrated wherein the conveying screw is arranged in a trough.
Figure 5A:
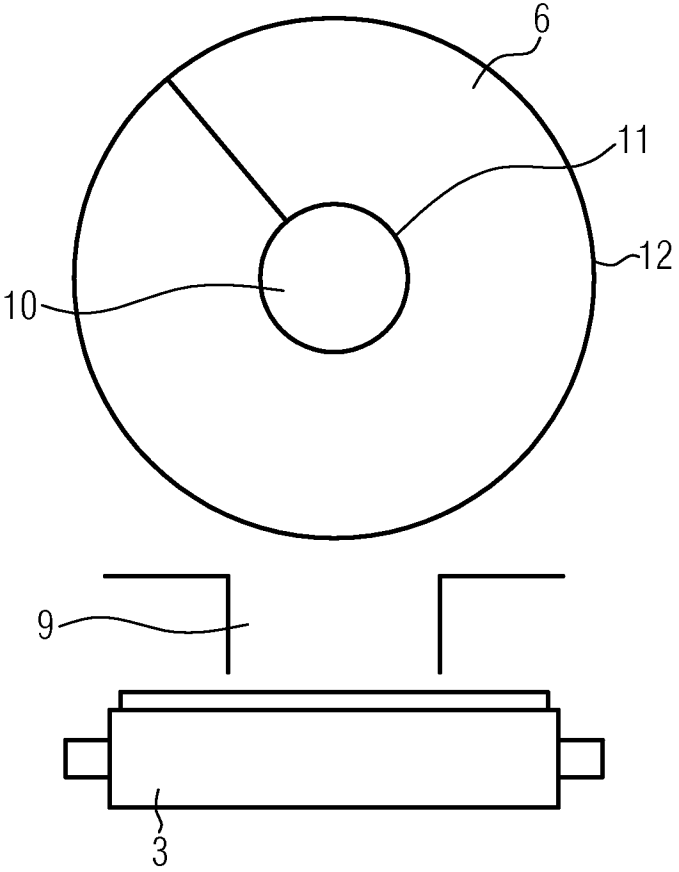
FIG. 5*a* is a schematic view in the direction of the conveying screw axis onto the conveying screw, showing the gap positioned thereunder and the downstream conveying system, in this case a scraper belt.

FIG. 5*a* and FIG. 5*b* show a schematic view of the longitudinal conveying screw 6, of the gap 9 and of the downstream conveying system 3 with a viewing direction from the rear wall 8 towards the axis of the longitudinal conveying screw 6. Here, FIG. 5*a* shows an embodiment without trough, and FIG. 5*b* shows an embodiment with trough. What can further be seen are the screw shaft 10 with the outer diameter 11 and the outer diameter of the screw flank 12. The trough walls 13 can additionally be seen in FIG. 5*b*. They extend downwards to such an extent that an interspace that is as small as possible remains relative to the downstream conveying system 3. This ensures that as little material as possible escapes through said interspace. The trough walls 13 are arranged in parallel with one another in this embodiment. Any desired angles, also negative ones, i.e., the gap opens into the opposite direction, can be chosen for the opening angle upwards and also for the opening towards the rear wall 8.

The gap 9 is here shown with a rectangular cross-section. It may, however, just as well have any desired cross-section. It may e.g., be trapezoidal or may be configured with roundings. Moreover, in addition to the gaps 9 underneath the longitudinal conveying screws 6, further gaps may be arranged underneath the transverse conveying screws 7. Likewise, gaps may be provided under all conveying screws of the material conveying system 5 and of the construction machine 1.

In the illustrated embodiment, the material conveying system 5 comprises a rear wall 8 as well as side walls. However, it may just as well be arranged without any additional walls directly in the area of the hopper 2.

In a further variant, the downstream conveying system 3, which is illustrated in the embodiment as a scraper belt, may be any desired type of conveying system.

Although it is possible with the system illustrated herein to optimize the homogeneity of the mixture with constant conveying screws 6, 7, one may additionally provide conveying screws 6, 7 with a conical screw shaft 10 or with an outer diameter of the screw flank 12 that is changing in conveying direction. Likewise, the pitch of the conveying screws may be configured to be variable.

In a further variant, it is conceivable to support the conveying screws 6, 7 at one side only; for instance, in the case of the longitudinal conveying screws 6, the bearing block could be omitted at the side of the rear wall 8, so that it does not present an obstacle to transportation. In the transverse conveying screws 7 the bearing could be omitted at the side of the longitudinal conveying screw 6, whereby an obstacle to the conveyor flow would also be avoided there.

Moreover, the material conveying system 5 can be used in any desired mobile or immobile construction machine that is processing bulk material. To be more specific, the bulk material may be bituminously bound mixtures, such as e.g., asphalts. The construction machine may e.g., also be a feeder.

All of the conveying screws 6, 7 may be operable independently of one another or also of the downstream conveying system 3. It is however also possible that the operation of all conveying systems of the construction machine is harmonized.

In a further variant, the operation of the conveying systems and of the individual conveying screws 6, 7 may be controlled by a control system 15 (see FIG. 2). The conveyor flows may here be controlled relative to one another in a previously defined ratio or they may be controlled situationally by the control system 15 e.g., on the basis of different sensors 16 belonging to the control system 15. The said sensors 16 may in particular be temperature sensors, weight sensors, density sensors, volume flow sensors, flow velocity sensors, or distance sensors.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A construction machine comprising:

a material hopper for receiving bulk material; and a material conveying system for conveying bulk material, the material conveying system comprising a conveying screw in the area of the hopper, wherein a gap extends underneath the conveying screw and the gap has a cross section which varies in a direction substantially parallel with an axis of the conveying screw, whereby the gap is configured to facilitate conveyance of the material.

2. The construction machine according to claim 1 wherein the gap extends substantially in parallel with the axis of the conveying screw.

3. The construction machine according to claim 1 wherein the gap is variably adjustable in its size during operation of the construction machine.

4. The construction machine according to claim 1 wherein the gap is downwardly open.

5. The construction machine according to claim 1 further comprising a downstream conveying system that extends underneath the gap and is arranged downstream of the gap, the downstream conveying system being configured to facilitate further transportation of the material.

6. The construction machine according to claim 1 wherein the conveying screw is arranged in a trough and the gap extends on a bottom side of the trough.

7. The construction machine according to claim 1 further comprising a plurality of the conveying screws, each conveying screw having a respective axis.

8. The construction machine according to claim 7 wherein the conveying screws are operable independently of one another.

9. The construction machine according to claim 7 wherein the conveying screws are arranged such that their axes extend at an angle or in parallel with one another.

10. The construction machine according to claim 7 wherein the conveying screws are arranged in a plurality of groups, the axes of the conveying screws within one group extending in parallel with one another.

11. The construction machine according to claim 10 wherein the groups are arranged such that the axes of the conveying screws of different groups extend at an angle relative to one another.

12. The construction machine according to claim 1 wherein a pitch of the conveying screw varies in the conveying direction.

13. The construction machine according to claim 1 wherein the conveying screw comprises a conical screw shaft.

14. The construction machine according to claim 1 wherein the conveying screw comprises a screw thread with a flank whose outer diameter changes in the conveying direction or remains constant.

15. The construction machine according to claim 1 wherein the conveying screw is supported at one side only.

16. The construction machine according to claim 1 further comprising at least one further conveying system arranged downstream of the conveying screw, and the conveying screw is operable in response to operating parameters of the at least one further conveying system.

17. The construction machine according to claim 7 further comprising a control system that is configured to control conveyor flows produced by the conveying screws and their ratio among one another.

18. The construction machine according to claim 1 wherein the construction machine is a road paver or a feeder.

19. A construction machine comprising:

a material hopper for receiving bulk material; and a material conveying system for conveying bulk material, the material conveying system comprising a conveying screw in the area of the hopper, wherein a gap extends underneath the conveying screw and the gap has a cross section which varies in a conveying direction of the conveying screw, and wherein the conveying screw is supported at one side only.

20. A construction machine comprising:

a material hopper for receiving bulk material;

a material conveying system for conveying bulk material, the material conveying system comprising a conveying screw in the area of the hopper, wherein a gap extends underneath the conveying screw and the gap has a cross section which varies in a conveying direction of the conveying screw; and at least one further conveying system arranged downstream of the conveying screw, wherein the conveying screw is operable in response to operating parameters of the at least one further conveying system.

* * * * *